US006189942B1

(12) United States Patent
Peterson et al.

(10) Patent No.: US 6,189,942 B1
(45) Date of Patent: Feb. 20, 2001

(54) SNOW RAKE

(76) Inventors: Francis Peterson, 807 College St., Prescott, WI (US) 54021; Paul Maire, 218 Eastbank Ct. North, Hudson, WI (US) 54016

( * ) Notice: Under 35 U.S.C. 154(b), the term of this patent shall be extended for 0 days.

(21) Appl. No.: 09/499,990

(22) Filed: Feb. 8, 2000

Related U.S. Application Data

(60) Provisional application No. 60/119,163, filed on Feb. 8, 1999.

(51) Int. Cl.[7] ..... E01H 5/02
(52) U.S. Cl. ..... 294/54.5; 37/285
(58) Field of Search ..... 294/49, 54.5, 59; 37/265, 266, 268, 284, 285

(56) References Cited

U.S. PATENT DOCUMENTS 3,998,486 * 12/1976 Mittelstadt ..... 37/285
4,089,127 * 5/1978 Maijala ..... 294/54.5
4,253,257 * 3/1981 Albert ..... 294/54.5
5,083,388 * 1/1992 Cooley ..... 37/285
5,570,524 * 11/1996 Groat ..... 37/285
5,943,796 * 8/1999 Hedstrom ..... 294/54.5

* cited by examiner

*Primary Examiner*—Dean J. Kramer
(74) *Attorney, Agent, or Firm*—Crompton, Seager & Tufte, LLC

(57) ABSTRACT

Devices and methods for removing snow are disclosed. A snow removal device in accordance with the present invention includes an elongate handle having a distal end and a proximal end, and a flexible sheet having a leading edge and a leading portion proximate the leading edge. The leading portion of the flexible sheet is fixed to the elongate handle proximate the distal end thereof. The flexible sheet has a first position defining a gliding surface, and a second position wherein the flexible sheet is substantially flat. The flexible sheet is, preferably, biased to assume the first position.

9 Claims, 4 Drawing Sheets

SNOW RAKE

CROSS REFERENCE TO RELATED APPLICATION

The present application claims the benefit of U.S. Provisional application Ser. No. 60/119,163, filed Feb. 8, 1999.

FIELD OF THE INVENTION

The present invention pertains to snow rakes. In particular, the present invention pertains to a snow rake including a low friction of lubricious sheath.

BACKGROUND OF THE INVENTION

Ice dams occur when water from melting snow freezes near the edge of a roof, such as a gutter line, and traps other melt water behind it. This water can run back up under the shingles and rot the wood sheathing and leak into the house. Snow melt can be caused by ambient weather conditions or from heat escaping from the house. One way of preventing ice damming is removing snow from the roof before the snow melts. To avoid the risks associated with climbing onto the roof, snow rakes have been developed which can be manipulated by a user on the ground.

Conventional snow rakes include an elongate handle and a blade disposed at the distal end of the handle. A user standing on the ground can lift the handle such that the blade is disposed several feet above the edge of a pitched roof. The blade is disposed transversely to the pitch or fall line of the roof. Then, the handle is pulled proximally toward the user. This drags the blade down the roof. As the blade is dragged down the roof, snow is scraped from the roof and falls downward. Depending upon the depth of the snow, several passes will be necessary to skim off successive layers of snow. After successive layers of snow have been skimmed off from a particular portion of the roof, until the roof is exposed, then the user can move the rake to another portion of the roof.

As several layers of snow must generally be skimmed off before an area of a roof is cleared or exposed, clearing a roof with a conventional snow rake can be a time consuming chore. It would thus be desirable to have a tool which can more efficiently be used to clear snow from a roof.

SUMMARY OF THE INVENTION

The present invention pertains to a snow rake for removing snow from a roof. The snow rake includes an elongate handle and a blade disposed at the distal end thereof. The blade extends transversely to the handle. An opening extends through the blade. A bottom portion of the blade is preferably sharpened to create a frost edge. Extending distally from the blade is a partially coiled, low friction lubricious sheath.

A user standing on the ground raises the blade several feet above the edge of a pitched roof. The blade is then drawn downward, slicing through the snow, until it reaches the surface of the roof. As the blade is drawn through the snow, most of the snow passes through the opening, remaining in place on the roof. The lubricious sheath, however, is uncoiled beneath snow as the blade is dragged downward. Once the sheath is disposed between the roof surface and the snow, the relatively high frictional interface between the snow and the roof is replaced by a low friction interface between the snow and the sheath. The snow then readily slides downward off the roof.

BRIEF DESCRIPTION OF THE DRAWINGS

Other objects in the present invention and many of the attendant advantages of the present invention will be readily appreciated as the same becomes better understood by reference to the following detailed description when considered in connection with the accompanying drawings, in which like reference numerals designate like parts throughout the Figures thereon and wherein.

DETAILED DESCRIPTION OF THE INVENTION

The following detailed description should be read with reference to the drawings, in which like elements in different drawings are numbered in like fashion. The drawings which are not necessarily to scale, depict selected embodiments and are not intended to limit the scope of the invention. In some cases, the drawings may be highly diagrammatic in nature. Examples of constructions, materials, dimensions, and manufacturing processes are provided for various elements. Those skilled in the art will recognize that many of the examples provided have suitable alternatives which may be utilized.

Figure 1:
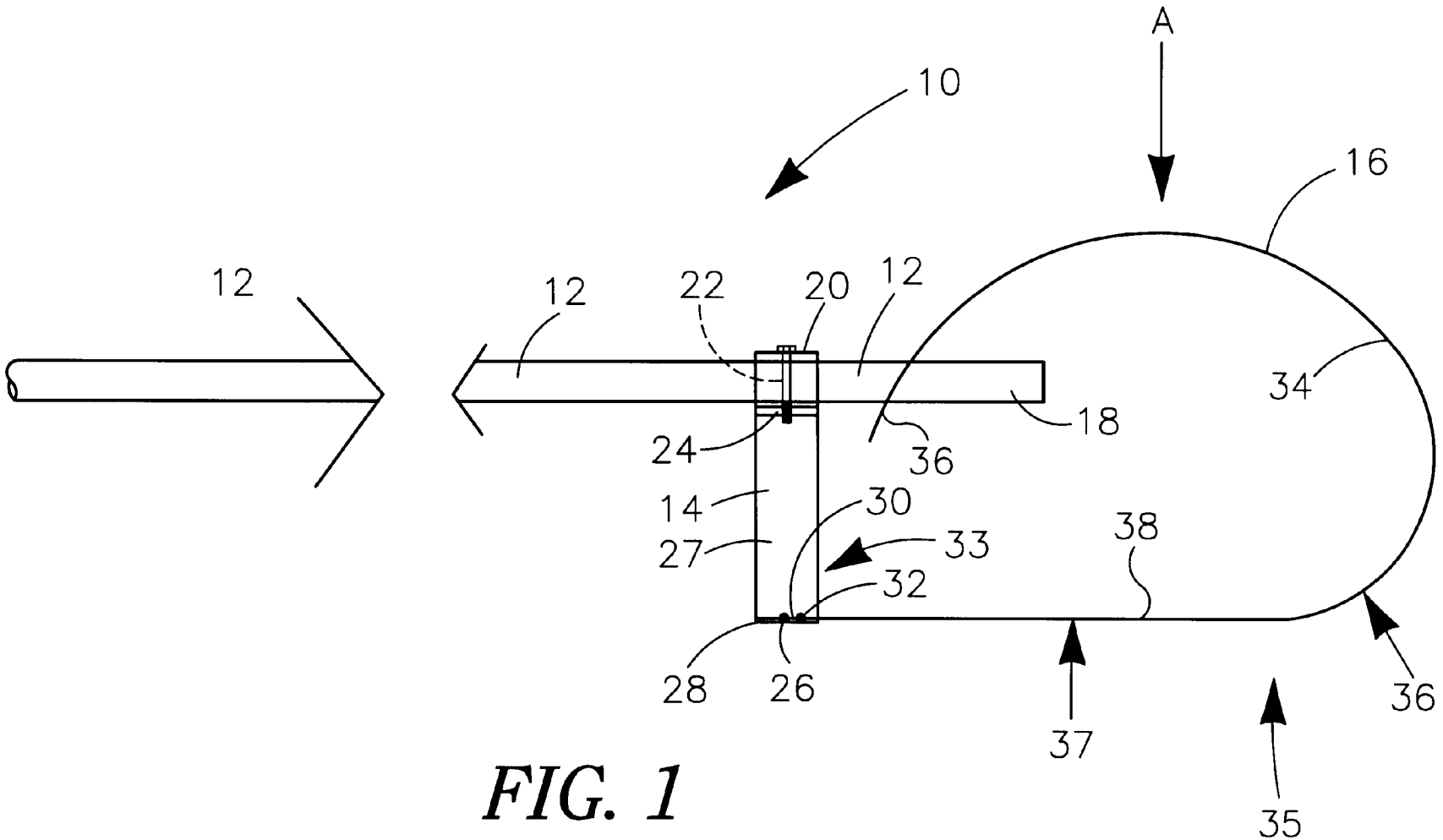
FIG. 1 is a side view of a snow rake in accordance with the present invention.

Referring now to the drawings, FIG. 1 is a side view of a snow rake 10 in accordance with the present invention. Snow rake 10 includes an elongate handle 12. Disposed near one end of handle 12 is a blade 14. Extending from blade 14 is a partially coiled lubricious sheet 16.

Handle 12 has a distal end 18. Handle 12 is preferably 10 to 20 feet long, or longer as is necessary to reach the roof of a structure. Handle 12 may be made from a single, elongate rod, a telescoping rod, or a rod which comes in several segments which can be connected together to create a handle 12 of sufficient length.

Blade 14 preferably includes a tubular coupling 20 through which handle 12 can extend. A screw, pin or other fastener 22 can extend through handle 12 and coupling 20 into a top portion 24 of blade 14. Blade 14 also includes a bottom portion 26. It can be appreciated, by reference to subsequent figures that blade 14 has a rectangular configuration extending transversely to handle 12. Top portion 24 and bottom portion 26 define the top and bottom of an opening extending through blade 14. Bottom portion 26 includes a proximal edge 28, which preferably is sharpened to create a frost-edge sufficiently sharp to slice through densely packed snow. A leading portion 33 of sheet 16 can be disposed in a recessed slot in bottom portion 26 and fastened thereto by screw or other fastener 32. Blade 14 is preferably made from a light metal, such as aluminum or plastic.

Sheet 16 is preferably biased into a partially coiled configuration including at least one curved portion 34 disposed between a leading edge 30 and a distal edge 36 of sheet 16. Sheet 16 is preferably formed such that it is internally biased to recoil if straightened. Lubricious sheet 16 preferably comprises a material which is durable, light weight, and provides a surface having a relatively low coefficient of friction. Examples of materials which may be suitable in some applications include: polyolefin, polyvinylchloride (PVC), polyurethane, polytetrafluoroethylene (PTFE), polyamide, and polyimide. Examples of polyolefins which may be suitable in some applications include polyethylene (PE) and polypropylene (PP). In a preferred embodiment, sheet 16 has a thickness between about 0.020 inches and 0.080 inches.

In FIG. 1, sheet 16 of snow rake 10 is disposed in a first position A. Sheet 16 may also assume a second substantially uncoiled position B. For example, blade 14 may be drawn downward, slicing through a layer of snow disposed on a roof. As blade 14 is drawn through the snow, sheet 16 will be uncoiled beneath a substantial portion of the snow as blade 14 is dragged downward. Once sheet 16 is disposed between the roof surface and the snow, the relatively high frictional interface between the snow and the roof is replaced by a low friction interface between the snow and sheet 16. The snow then readily slides downward off the roof. In a preferred embodiment, sheet 16 is biased to assume position A when there are no outside forces (e.g., the weight of the snow) acting on it.

In FIG. 1, it may be appreciated that sheet 16 includes curved portion 34 when sheet 16 disposed is in first position A. Sheet 16 defines a gliding surface 35. When snow rake 10 is being utilized to clear snow from a roof, gliding surface 35 may be utilized to assist in positioning snow rake 10. For example, the distal end of snow rake 10 may be lifted to a location proximate the lowest portion of the roof. Snow rake 10 may then be lowered until gliding surface 35 of sheet 16 contacts the roof or a layer of snow overlaying the roof. It may be appreciated that resting gliding surface 35 on the roof will significantly reduce the force required from the person using the roof rake. The distal end of snow rake 10 may be advanced to a higher location of the roof by pushing distally on handle 12 and allowing gliding surface 35 to slide along the roof or a layer of snow overlaying the roof.

In FIG. 1 it may be appreciated that gliding surface 35 includes a curved surface portion 36 and a substantially flat surface portion 37. Curved surface portion 36 is defined by curved portion 34 of sheet 16. Substantially flat surface portion 37 is defined by an intermediate portion 38 of sheet 16. Intermediate portion 38 of sheet 16 is disposed between leading edge 30 and trailing edge 36 of sheet 16. Embodiments of the present invention have been envisioned in which intermediate portion 38 of sheet 16 includes one or more ribs.

In the embodiment of FIG. 1 leading portion 33 of sheet 16 is rotationally fixed relative to blade 14. Also in the embodiment of FIG. 1, substantially flat surface portion 37 of gliding surface 35 is disposed such that it is substantially parallel to handle 12. As described above, gliding surface 35 on the roof or on a layer of snow overlaying the roof. The distal end of snow rake 10 may be advanced to a higher location of the roof by pushing distally on handle 12 and allowing gliding surface 35 to slide along the roof or a layer of snow overlaying the roof. In the embodiment of FIG. 1, a pushing force applied along the longitudinal axis of handle 12 will have a direction which is substantially parallel to gliding surface 35. Other embodiments are possible without deviating from the spirit and scope of the present invention. For example, handle 12 could be pivotally connected to blade 14 and include a fastener allowing the angle between blade 14 and handle 12 to be fixed at an angle desired by the user of snow rake 10.

Figure 2:
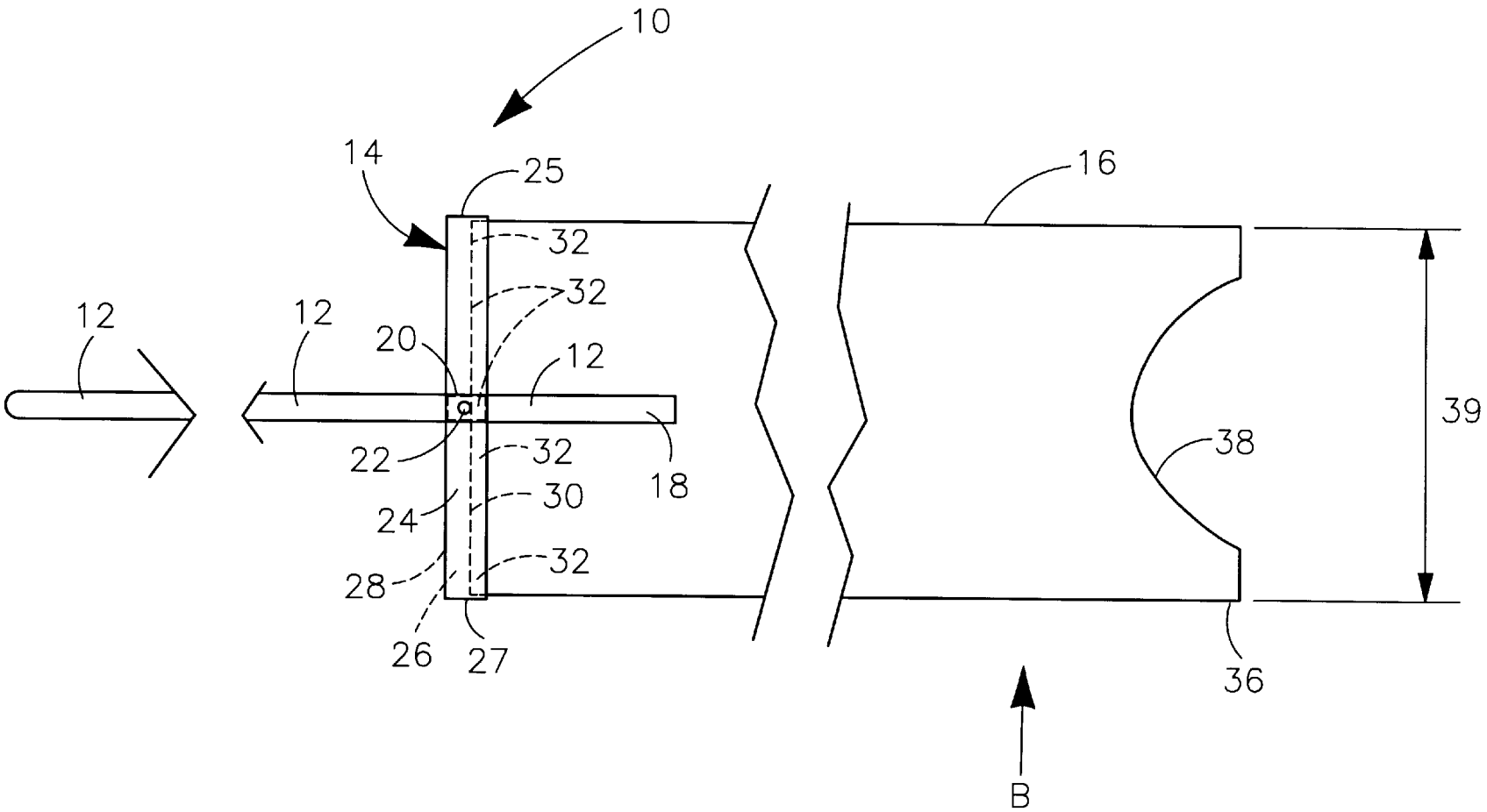
FIG. 2 is a top view of a snow rake in accordance with the present invention.

FIG. 2 is a top view of snow rake 10 with sheet 16 disposed in substantially uncoiled position B. In FIG. 2 it can be seen that blade 14 extends transversely to handle 12. A plurality of fasteners 32 arc shown connecting leading portion 33 of sheet 16 to bottom portion 26 of blade 14. Side portions 25 and 27 of blade 14 are also shown. Distal edge 36 of sheet 16 defines a handle cut 38. In a preferred embodiment, handle cut 38 is adapted to be disposed about handle 12 when sheet 16 is in first position A. Sheet 16 preferably has a transverse dimension 39 approximately equal to the transverse dimension of the opening through blade 14 between side portions 25 and 27.

Figure 3:
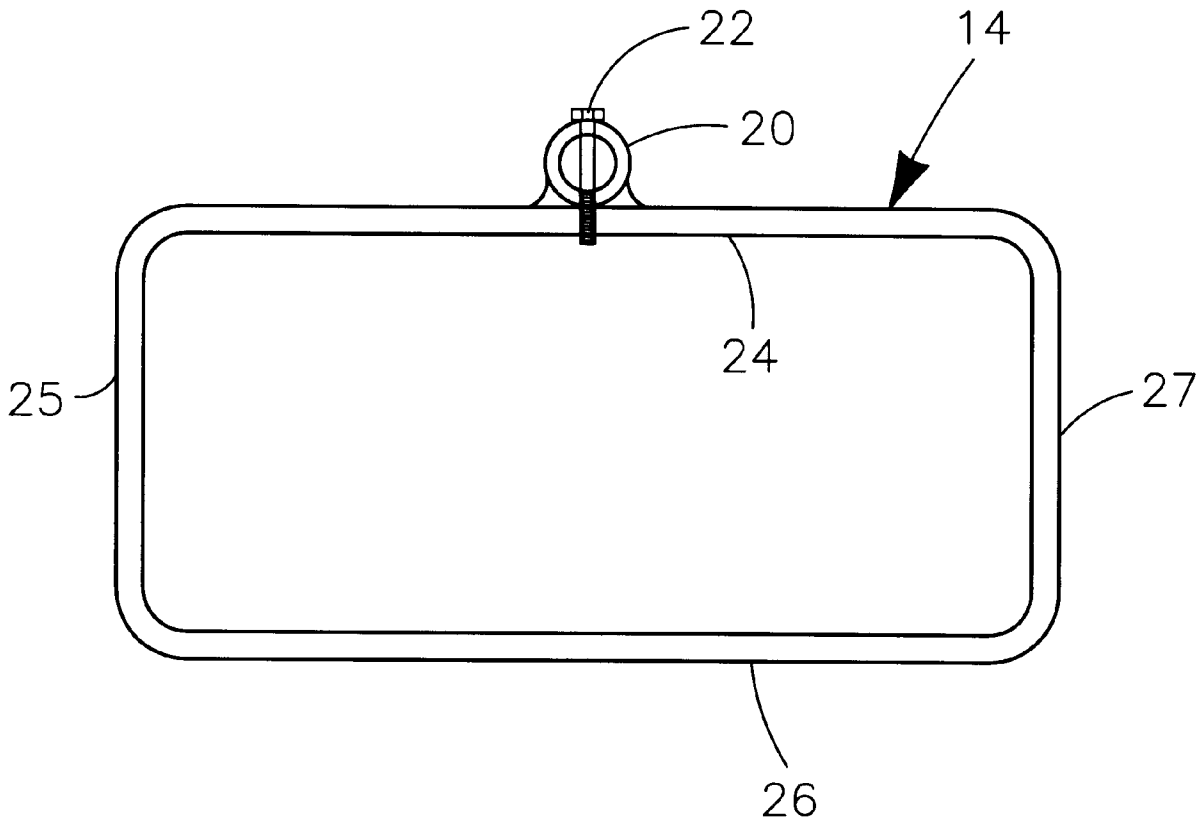
FIG. 3 is a front view of the blade of the snow rake in accordance with the present invention.

FIG. 3 is a front view of blade 14 showing top portion 24, bottom portion 26 and side portions 25 and 27 defining an opening therebetween. Tubular coupling 20 is disposed on, and preferably welded to, top portion 24 and screw 22 extends through coupling 20 and into tip portion 24. Blade 14, as shown, has a generally rectangular configuration and opening. It can be appreciated, however, that blade 14 could have alternate shapes, such as a triangular shape.

Figure 4:
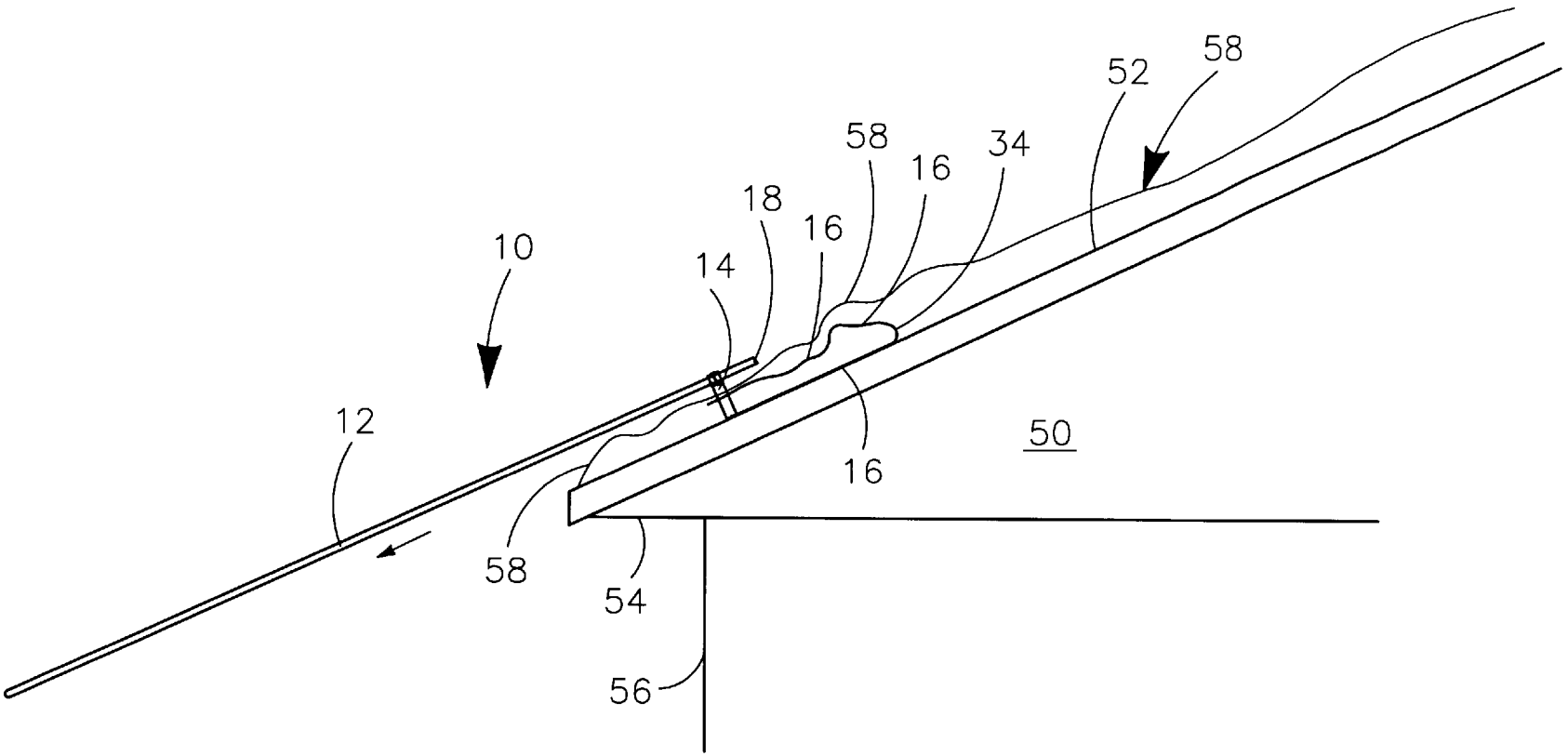
FIG. 4 is an end view of a gabled roof and the snow rake of the present invention.

FIG. 4 is a side view of snow rake 10 and a gable end of a roof 50. Roof 50 has a roof surface 52 which can have a soffit 54 extending from a wall 56. A layer of snow 58 is disposed on roof surface 52. Snow rake 10 has been advanced onto roof surface 52 sufficiently high to have placed blade 14 at approximately the current location of curved portion 34 of sheet 16. In the position shown in FIG. 4, blade 14 has been drawn downwardly in the direction of the arrow adjacent to handle 12 Such that a portion of sheet 16 is now disposed beneath snow 58. Snow rake 10 is preferably pulled further in the direction of the arrow until blade 14 is pulled to the edge of roof surface 52. While blade 14 is drawn downward along roof Surface 52, sheet 16 is sufficiently flexible to uncoil under snow 58. When sheet 16 is uncoiled, it will extend from approximately as high on the roof as curved portion 34 is shown in FIG. 4 to the edge of roof surface 52. When lubricious sheet 16 is disposed under snow 58 in this manner, the friction holding snow 58 to roof surface 52 will be reduced substantially by the interpositioning of sheet 16. The snow on sheet 16 will then readily slide downwardly from roof surface 52. A sufficient amount of snow should be removed from the roof to reduce or eliminate the potential of ice damming as can be appreciated by those skilled in the art.

It can be appreciated that sheet 16, when partially coiled resembles a toboggan, and thus can act as a toboggan to carry blade 14 over snow 58 of FIG. 4. It can also be appreciated that coupling 20 could be configured to allow the angle of handle 12 to be varied relative to blade 14. For example, coupling 20 could be pivotally connected to blade 14 and include a fastener allowing the angle between blade 14 and handle 12 to be fixed at a desired angle. Handle 12 could also be reversed such that snow could be pushed from the roof when a person was standing above blade 14 on the roof rather than below as shown in FIG. 4.

Numerous characteristics and advantages of the invention covered by this document have been set forth in the foregoing description. It will be understood, however, that this disclosure is, in many respects, only illustrative. Changes may be made in details, particularly in matters of shape, size and ordering of steps without exceeding the scope of the invention. The invention's scope is, of course, defined in the language in which the appended claims are expressed.

What is claimed is:

1. A snow removal device comprising;

an elongate handle having a distal end and a proximal end;

a flexible sheet having a leading edge and a leading portion proximate the leading edge;

the leading portion of the flexible sheet being fixed to the elongate handle proximate the distal end thereof;

the flexible sheet having a first position defining a gliding surface;

the flexible sheet having a second position wherein the flexible sheet is substantially flat; and wherein the flexible sheet is biased to assume the first position.

2. The snow removal device of claim 1, wherein the gliding surface defined by the flexible sheet includes a substantially flat surface and an upwardly curving surface.

3. The snow removal device of claim 1, wherein the flexible sheet includes a trailing edge defining a notch.

4. The snow removal device of claim 1, wherein the flexible sheet includes a trailing edge defining a notch; and wherein the notch is adapted to be disposed about the elongate handle when the flexible sheet is in the first position.

5. A snow removal device comprising;

an elongate handle having a distal end and a proximal end;

a flexible sheet having a trailing edge, a leading edge, and a leading portion proximate the leading edge;

the leading portion of the flexible sheet being fixed to the elongate handle proximate the distal end thereof;

the flexible sheet further including a curved portion disposed between the leading edge and the trailing edge;

the trailing edge of the flexible sheet defining a notch; and a proximal portion of the elongate handle being disposed within the notch defined by the trailing edge of the flexible sheet.

6. The snow removal device of claim 5, wherein the curved portion of the flexible sheet defines an upwardly curving surface portion of a gliding surface defined by the flexible sheet.

7. The snow removal device of claim 5, wherein the flexible sheet further includes an intermediate portion disposed between the leading portion and the curved portion thereof; and the intermediate portion of the flexible sheet defines a substantially flat surface portion of a gliding surface defined by the flexible sheet.

8. The snow removal device of claim 5, wherein the flexible sheet has a thickness between about 0.020 inches and about 0.080 inches.

9. The snow removal device of claim 5, wherein the leading portion of the flexible sheet is rotationally fixed relative to the elongate handle.

* * * * *